US007549642B2

(12) United States Patent
Centrone

(10) Patent No.: US 7,549,642 B2
(45) Date of Patent: Jun. 23, 2009

(54) METHOD AND DEVICE FOR CONDUCTING A BLACKJACK-TYPE CARD GAME

(75) Inventor: Joseph Centrone, Margate, NJ (US)

(73) Assignee: Nu Games LLC, Margate, NJ (US)

( * ) Notice: Subject to any disclaimer, the term of this patent is extended or adjusted under 35 U.S.C. 154(b) by 190 days.

(21) Appl. No.: 11/511,996

(22) Filed: Aug. 28, 2006

(65) Prior Publication Data

US 2007/0284820 A1 Dec. 13, 2007

Related U.S. Application Data

(63) Continuation-in-part of application No. 10/989,708, filed on Nov. 15, 2004, now Pat. No. 7,097,175, which is a continuation-in-part of application No. 10/250,271, filed on Jun. 19, 2003, now abandoned.

(51) Int. Cl.
*A63F 1/00* (2006.01)

(52) U.S. Cl. ..... 273/292; 273/274; 463/12

(58) Field of Classification Search ..... 273/292, 273/274, 309; 463/12, 13
See application file for complete search history.

(56) References Cited

U.S. PATENT DOCUMENTS

| | | | | |
|---|---|---|---|---|
| 5,174,579 | A * | 12/1992 | Griffiths | 273/292 |
| 5,288,077 | A | 2/1994 | Jones | |
| 5,577,731 | A | 11/1996 | Jones | |
| 5,615,888 | A * | 4/1997 | Lofink et al. | 273/292 |
| 5,816,575 | A * | 10/1998 | Keller | 273/292 |
| 5,836,586 | A * | 11/1998 | Marks et al. | 273/292 |
| 5,839,730 | A | 11/1998 | Pike | |
| 6,845,981 | B1 | 1/2005 | Ko | |

* cited by examiner

*Primary Examiner*—Benjamin H Layno
(74) *Attorney, Agent, or Firm*—Porzio, Bromberg & Newman, P.C.

(57) ABSTRACT

A game begins with a game wager and an optional bust wager. The initial dealer hand and the initial player hand are dealt. A final dealer hand and final player hand are formed by hitting or standing and the player is rewarded on his game wager if the final player hand is closer to a target value than the final dealer hand is. If the dealer busts on exactly three cards, the player wins the bust wager. Payoff on the bust wager is optionally variable and determined by the third card of the final dealer hand.

13 Claims, 2 Drawing Sheets

METHOD AND DEVICE FOR CONDUCTING A BLACKJACK-TYPE CARD GAME

RELATED APPLICATION DATA

The present application is a continuation-in-part of U.S. patent application Ser. No. 10/989,708, entitled "Method and Device for Conducting a Blackjack-Type Card Game," filed on Nov. 15, 2004 now U.S. Pat. No. 7,097,175 by Applicant herein, which is a continuation-in-part of U.S. patent application Ser. No. 10/250,271, entitled "Double Attack Blackjack Card Game Method of Play," filed on Jun. 19, 2003 now abandoned by Applicant herein.

FIELD OF THE INVENTION

The present invention relates to a method and device for conducting a game using playing cards. Specifically, the present invention is a method and device for conducting a Blackjack-type card game in which a player is afforded an opportunity to place a wager on the dealer busting, with the payoff on that wager being dependent upon a revealed card of the dealer hand.

BACKGROUND OF THE INVENTION

Many casino games include players playing against the house to obtain a player hand having a value closer to a target value than the house hand is. For example, Blackjack, Spanish Twenty-One®, and the like all-fit this pattern.

Blackjack is a well known card game played in casinos. The object of the game is to have a final hand sum closer to twenty-one than the dealer's final hand sum is to twenty-one without exceeding twenty-one. For purposes of calculating a hand total, each card has a value equal to its face value except face cards, which have a value of ten, and Aces, which may have a value of eleven or one as the player selects.

The form of Blackjack played in casinos is house banked. This means that the house is represented by a dealer who deals cards, pays winning player wagers, and collects losing player wagers. Similarly, in a Blackjack game machine, the machine controls a house hand and handles collection and payment of wagers, while a player controls the player hand.

In a typical Blackjack game, each player makes a wager. The dealer, whether live or represented by a game machine, deals two cards to each player and two cards, one card face up and the other face down, to the dealer. Any player receiving a natural twenty-one or Blackjack, i.e. a total of twenty-one in the initial dealt hand, is immediately rewarded, typically at a rate of 2:1 or 3:2, and play is terminated as to that player. Each remaining player examines the player's hand and forms a final player hand. In forming the final player hand, the player may hit, i.e. receive another card, or stand, i.e. stop receiving additional cards and make final the current hand. A player may hit as many times as the player wishes as long as the player does not bust, i.e. have a cumulative total greater than twenty-one. When a player busts, the player's wager is immediately collected and play is terminated as to that player.

A player may also have additional options available depending on the initial hand dealt. If the player receives a pair, i.e. two cards having the same face value, the player may split the pair and use each card as a basis for a separate hand. For example, if a player were to be dealt a pair of eights, the player may choose to split the pair and continue play with two hands each having an eight and an additional dealt card. Each of those individual hands is then played independently.

A player may also have the option to double down. The availability of the double down option will vary from casino to casino. However, in all cases, the option allows a player to double the player's wager in exchange for a single additional card. For example, if a player has a initial hand total of eleven, the player may wish to double down, betting that the single additional card dealt is a ten. However, because of the nature of the double down wager, even if the next card is a three, for example, the player cannot receive any additional cards.

After all the players have played their hands, the dealer reveals the face-down card in the dealer's hand. The dealer plays the dealer's hand according to established house rules. That is, the house uses established "house rules" to eliminate the dealer's discretion, so that the dealer hits or stands as the house rules dictate. The dealer then resolves the wagers. In resolving the wagers, players with a final hand total closer to twenty-one than the dealer's final hand total are rewarded at even money. Conversely, wagers are collected from players with a final hand total further from twenty-one than the dealer's final hand total. If the dealer busts, all players who did not bust or receive a Blackjack are rewarded. If the player and dealer push, i.e. have the same final hand total, the player's wager is returned.

Blackjack is a well established and, to some, routine game. It is known that players are drawn to new features on conventional games, especially when those features can lead to higher or more frequent pay outs. One method for a player to increase the excitement and potential win for the player is to offer the player an option to make an additional wager.

For example, Griffiths, U.S. Pat. No. 5,174,579, is directed to a game in which a side wager is placed on a dealer Blackjack or bust, i.e. a draw to a total greater than twenty-one, on three or more playing cards. The drawback of the side wager of Griffiths is that there is no provision for the player to be paid more than even money. That is, differentiation in the payouts for different outcomes even though certain outcomes would be less likely to occur than others.

SUMMARY OF THE INVENTION

A method and device for conducting a card game between a dealer and a player. While the constitution of the deck of cards could take many different forms, in an optional embodiment, a modified deck consisting essentially of four cards each of Ace, deuce, three, four, five, six, seven, eight, nine, Jack, Queen, and King is used.

The present invention may be considered an improved method for conducting a card game according to the conventional rules of Blackjack, or a game such as Spanish Twenty-One which is based upon the conventional rules of Blackjack. In such an embodiment, the game includes the player making an initial game wager. In addition, a bust wager is placed. The bust wager may be optional, i.e. the player may be allowed to decline to place a bust wager, or the bust wager may be mandatory.

In an optional embodiment, the bust wager may be placed at the same time as the game wager. In another optional embodiment, the bust wager may be placed after the player has received the player's hand, but before the dealer has revealed the dealer's up card.

The player forms a final player hand and the dealer forms a final dealer hand according to the conventional rules of Blackjack. Optionally, the dealer acts according to a predetermined set of house rules. Similarly, in an optional embodiment, the player may have the additional option of splitting or doubling down according to the conventional rules of Blackjack in forming the player's final hand or hands. In an optional embodiment, if the player splits or doubles down, the player places an additional split wager or double down wager up to the amount of the game wager.

A reward is issued to the player on the player's game wager if the final player hand outranks the final dealer hand according to the conventional rules of Blackjack. Conversely, the player's game wager is collected if the final dealer hand outranks the final player hand according to the conventional rules of Blackjack.

The bust wager is resolved based on whether the dealer hand busts, i.e. hits and receives a card causing the hand sum to exceed the target value. For example, in one optional embodiment, if the dealer busts according to the conventional rules of Blackjack, and the final dealer hand includes exactly three playing cards, a reward is issued to the player based on the bust wager. Optionally, the reward based on the bust wager varies according to the value of the playing card causing the dealer to bust. Optionally, resolution of the bust wager is independent of the player final hand. For example, in one such optional embodiment, a bust wager may be resolved for a player even if that player has busted or received an automatic winning hand, e.g. a Blackjack.

The present invention may also be embodied in a device, such as a gaming machine or general purpose computer executing software instructions. Such a device includes a data processor communicating with a display, an input device, a wager receiver, and a data structure. The data structure stores data representing playing cards, optionally a modified deck of playing cards, a set of house rules, and instructions executable by the data processor for conducting a game method.

The game method executed by the data processor includes receiving a signal from the wager receiver in response to receipt of a game wager from the player. In addition, the data processor receives a signal from the wager receiver in response to either receipt of a bust wager, or a player indication declining the option of a bust wager. In response to these signals, an two cards are dealt to the player to form an initial player hand and two cards are dealt dealer to form an initial dealer hand. Optionally at least one dealer card may be revealed prior to the player forming the final player hand.

If the initial player hand forms an automatic winning outcome, a reward is issued to the player and play by the player is terminated. Otherwise the player forms a final player hand by opting through the input device to receive additional cards or stand on the initial player hand. Optionally, the player may have to option to split or double down when forming the final player hand or, in the case of one or more splits, final player hands.

The initial dealer hand is revealed at the display and a final dealer hand is formed according to the house rules. Wagers are resolved by issuing a reward to the player on the player's game wager if the final player hand is closer to a predetermined target value than the final dealer hand is or collecting the player's game wager if the final dealer hand is closer to a predetermined target value than the final player hand is.

Each bust wager is resolved by determining whether the dealer has exceeded the predetermined target value. In an optional embodiment, if the dealer exceeds the predetermined target value, and the final dealer hand includes three playing cards, a reward is issued to the player based on the bust wager. In an optional embodiment, the size of the reward varies according to the value of the playing card causing the dealer to bust. Conversely, if the dealer does not exceed the predetermined target value, or the dealer exceeds the predetermined target value with a final dealer hand including four or more playing cards, the bust wager is collected.

DESCRIPTION

Figure 1:
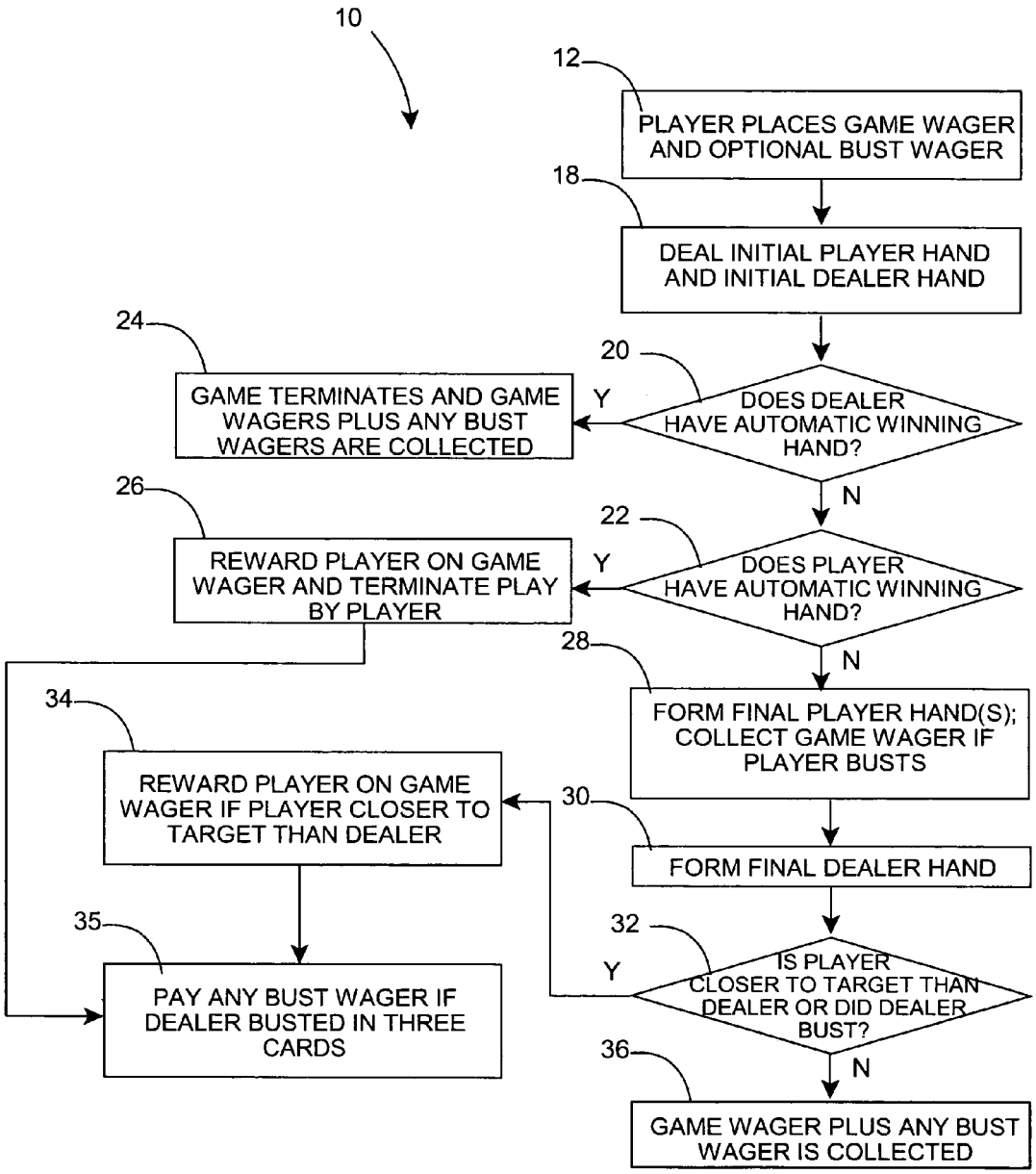
FIG. 1 is a flow chart of a method according to an embodiment of the present invention.
Figure 2:
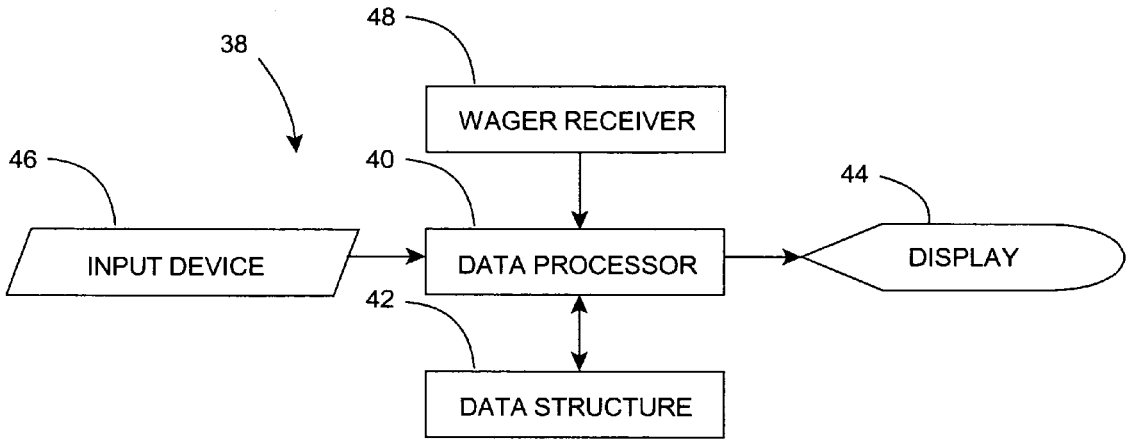
FIG. 2 is a block diagram of a device according to an embodiment of the present invention.

Reference is now made to the figures wherein like parts are referred to by like numerals throughout. Referring generally to FIGS. 1 and 2, the present invention is a method 10 and device 38 for conducting a game. It is noted that the present game may be conducted in a live version, using physical playing cards and a live dealer, in an electronic version, using electronic playing cards and a computer-controlled dealer, or in a hybrid version using some live aspects and some electronic aspects.

The game of the present invention utilizes playing cards or electronic representations thereof. In conducting the present game, any quantity of playing cards could be used. For example, the present game could be dealt from a single deck, or from multiple decks. Additionally, each deck may have a conventional constitution of fifty-two cards, a supplemented constitution of more than fifty-two cards, or a modified constitution of fewer than fifty-two cards. For example, in one optional embodiment, the present invention is conducted using a modified deck consisting essentially of forty-eight cards: four Aces, four deuces, four threes, four fours, four fives, four sixes, four sevens, four eights, four nines, four Jacks, four Queens, and four Kings. In such an optional embodiment, as previously noted, one or more such modified decks may be used. It is noted that the deck could also be modified in other manners, such as by eliminating other ten-value cards in addition to, or in place of, the ten spot cards.

One or more players play against a house dealer. In the case of a gaming machine, the gaming machine usually acts as the dealer. In the case of a live table game, the dealer is typically a person. In either event, the dealer typically, although not necessarily, plays according to a predetermined set of house rules dictating the formation of the final dealer hand as discussed in greater detail below.

As shown in FIG. 1, according to the present invention, each player places 12 a game wager and a bust wager. It is noted that the bust wager may be optional, as shown in FIG. 1, or may be mandatory. In a table embodiment, the game wager and bust wager may be subject to table limits; in a machine embodiment, the game wager and bust wager may also be subject to certain game limits.

The point at which the bust wager is placed could vary. For example, in one optional embodiment, a player is permitted to place the bust wager after receiving the initial player hand, but before the dealer has received the initial dealer hand. In another optional embodiment, the initial dealer hand may be dealt to the dealer, but no card exposed until after the player has decided whether to place a bust wager.

At some point, the initial dealer hand and initial player hand are dealt 18 to the dealer player respectively. Optionally, the initial dealer hand includes one card dealt face-up and one card dealt face down. Again, in one optional embodiment, the sequence of these events would proceed from each player placing a game wager and opting whether to place a bust wager, to dealing both an initial player hand to each player and in initial dealer hand to the dealer. However, this sequence could vary. As noted above, in an optional embodiment, a portion or all of the player hand could be dealt prior to the player placing a bust wager. Similarly, the dealer's initial hand could be dealt before or after the player places a bust wager and/or before or after the initial player hand is dealt. In short, the sequence of events of the embodiment of FIG. 1 should be taken as illustrative rather than restricting.

After the player has obtained his or her initial player hand, in an optional embodiment, the player determines 22 whether the player has an automatic winning holding. For example, if the present invention is applied to Blackjack, the player automatically wins if the initial player hand is a natural twenty-one, i.e. a ten-value card, such as a ten, Jack, Queen, or King, in combination with an Ace. It is noted that in an optional embodiment, the dealer and player may push if both have a natural twenty-one. Nonetheless, in an embodiment providing for such an outcome, a player obtaining an automatic winning holding may be rewarded 26 and play may be terminated for that player, although, in an optional embodiment, any bust wager placed may remain pending resolution. While the pay outs for an automatic winning holding could vary according to house rule, in an optional embodiment applied to Blackjack, the player is rewarded at even money for obtaining a natural twenty-one.

In an optional embodiment, an insurance wager may be provided. In such an optional embodiment, a player may be eligible to place an insurance wager, optionally limited to an amount less than or equal to the player's game wager, when the dealer's face-up card is a certain value. In an optional embodiment of the present invention applied to conventional Blackjack, insurance is available when the face-up card dealt to the dealer is an Ace or, under certain house rules, an Ace or ten-value card. In such an optional embodiment, a dealer having 20 a natural twenty-one, i.e. an Ace plus a ten-value card in his initial dealer hand, collects 24 game wagers from each player who does not also have a natural twenty-one, but pays each player placing an insurance wager. Optionally, the insurance wager is paid at greater than even money, such as, for example, 5:2 or 2:1.

If the player does not have an automatically winning hand, the player forms 28 a final player hand by hitting, i.e. receiving additional playing cards, or standing, i.e. making final the cards held by the player at that time. In an optional embodiment of the invention, the goal of the game is to obtain a hand closer to a predetermined target value than the dealer's hand is. For example, in an embodiment in which the present invention is applied to a conventional Blackjack game, the goal for the player is to obtain a hand sum closer to twenty-one than the dealer's hand sum is, without exceeding twenty-one. Thus, a player with a hand of K♢ 9♤ would likely stand, whereas a player with a hand of 7♤2♢ would likely hit.

In an optional embodiment applied to Blackjack, the player may also have the option of splitting the player's hand or doubling down when forming 28 the final player hand or, in the case of one or more splits, final player hands. Splitting involves the player holding a pair in his initial player hand placing an additional split wager, in this case an amount up to the game wager, and playing each of the cards of the pair as a separate hand. In an optional embodiment, the player is required to place an additional split wager equal to the game wager. For example, suppose a player who placed a game wager of 10 units is dealt 8♤ 8♡. If the player wishes wish to split the pair, the player places a split wager of 10 units and is then allowed to use the 8♤ and 8♡ as the bases for separate hands. In a further optional embodiment, the player may be permitted to re-split a player hand a limited number of times or indefinitely if the player again obtains a pair after a split.

A double down wager may also be allowed. Moreover, in an optional embodiment, the double down wager may be combined with the split wager in that a player may be permitted to double down on one or both new hands after splitting a hand. Additionally, unlike conventional double down wagers, in an optional embodiment, the player may be permitted to place a double down wager on any quantity of playing cards with any hand sum. In a double down, the player places a double down wager less than or equal to the game wager. For example, in such an embodiment, assuming the game wager is 10 units, a player could place a double down wager of 10 or fewer units. In exchange for such a double down wager, the player is dealt one, and only one, additional card.

After each player has formed 28 a final player hand, the dealer forms 30 a final dealer hand. In an optional embodiment, the dealer may form 30 his final dealer hand according to house rules that leave the dealer no discretion in forming the final dealer hand. Nonetheless, the dealer hits or stands and, eventually, forms 30 a final dealer hand.

The final dealer hand and final player hand are compared 32 to the target value. The player is rewarded 34 based on the player's game wager if the final player hand is closer to the target value than the final dealer hand is. Similarly, the player may be rewarded 34 if the dealer exceeded the target value and the player did not. For example, in an optional embodiment applied to Blackjack, a player with a final player hand sum of 19 would be rewarded if the dealer had a final dealer hand sum of 18 or less, or 22 or more. Optionally, the player would push if the dealer and player have the same hand sum and the player's game wager would be collected 36 if the final dealer hand is closer to the target value than the final player hand is. Thus, in the example above in which the final player hand sum is 19, a push occurs if the final dealer hand sum is 19 and the player's game wager would be collected if the final dealer hand sum is 20 or 21.

In the event of a player win, the player is rewarded 30 based on the game wager. For example, if a player places a 10 unit game wager, a winning player hand results in a payout on the wager of 10 units. Optionally, the payout is even money; thus, in the example, a winning player would be paid 10 units.

Additionally, an optional bust wager may be placed 12, typically prior to the dealing of any playing cards as discussed above. Such a bust wager would be a proposition wager that the dealer hand would bust, i.e. exceed a hand total of 21, on the third card dealt to the dealer. For example, suppose a dealer has an initial hand of 8♢ 7♤ and hits to obtain a J♡, the dealer has busted in three cards. Any player placing the bust wager in such an example game would be rewarded 34 on the bust wager amount. While the payout could be a constant value or multiplier, in an optional embodiment, the payout for the bust wager may optionally depend upon the value of the third card, i.e. the card causing the dealer to bust. For example, one optional pay table applicable to use with a Spanish deck, i.e. a deck from which the 10s have been removed, is shown in Table 1:

TABLE 1

| Third Card Drawn | Payout |
|---|---|
| Face Card | 3 to 1 |
| Nine | 6 to 1 |
| Eight | 8 to 1 |
| Seven | 10 to 1 |
| Six | 15 to 1 |
| Bonus for 8 8 8 of Same Color | 50 to 1 |
| Bonus for 8 8 8 Suited | 200 to 1 |

In an alternate optional embodiment utilizing a full standard blackjack or poker deck, i.e. a deck containing 2s through 10s, Jacks, Kings, and Queens, and Aces, one optional pay table is shown in Table 2:

TABLE 2

| Third Card Drawn | Payout |
|---|---|
| King, Queen, Jack, or Ten | 3 to 1 |
| Nine | 5 to 1 |
| Eight | 7 to 1 |
| Seven | 9 to 1 |
| Six | 15 to 1 |
| Bonus for 8 8 8 of Same Color | 50 to 1 |
| Bonus for 8 8 8 Suited | 200 to 1 |

The present method could also be applied to a device 38 for conducting a game for a player. As discussed above, in such an embodiment, the dealer may be live or represented by the game device. It is further noted that the game device could be a specific use game device, such as a video card machine, or could be a general purpose computer programmed to conduct the present game.

A device according to the present invention includes a data processor 40. The data processor 40 could take any form. The data processor 40 communicates with a display 44, optionally through a display controller. The display 44 could be any form including cathode ray tube ("CRT"), liquid crystal display ("LCD"), plasma, or the like. The data processor 40 also communicates with a wager receiver 48. The wager receiver 48 could be any means for receiving a wager or wager data. For example, the wager receiver 48 could receive coins; bills; tokens; encoded vouchers, tickets, or script; account data, such as banking or credit card data; or any other form of data or media representing a wager. The data processor 40 also communicates with an input device 46. The input device 46 could include any device usable by the player to input information or make selections, such as buttons, a keypad or keyboard, a touchscreen, or any other input device.

A data structure 42 communicating with the data processor 40 stores electronic representations of playing cards (optionally with a full or modified deck constitution as discussed above), a set of house rules including pay outs, and instructions executable by the data processor for conducting a game method. The data structure 42 could be any structure storing data including any type of optical, magnetic, flash, electrical, or electronic memory, in any form, such as random access memory ("RAM"), read-only memory ("ROM"), or any of the many variations thereon. It is also noted that each of these elements, i.e. the data processor 40, data structure 42, display 44, input device 46, and wager receiver 48, need not be physically proximate but may be remote from one another and, in such an embodiment, could communicate via computer network, telephone line, wireless communication, or the like.

Referring to FIGS. 1 and 2, in conducting the game method, the data processor receives a signal from the wager receiver 48 indicating the placing 12 of a game wager by the player as well as either the placing or declination of the bust wager. In response to this signal, the data processor 40 randomly selects and "deals" 18 an initial player hand and an initial dealer hand for the dealer or assigns the cards to the appropriate hand. The cards of the initial player hand are exposed at the display 44 as is optionally one card of the initial dealer hand.

Again, as above, the initial player hand could be dealt and revealed before the placement of the bust wager. Likewise, the initial dealer hand could be dealt prior to the placement of the bust wager. However, the optionally exposed dealer card may only be revealed after the player has opted whether or not to place a bust wager. As above, if a player has an automatic winning hand 22, in the case of Blackjack such a hand would be a natural twenty-one, the player is rewarded 26, optionally at even money, and play by the player is terminated. If the dealer has an automatic winning hand 20, the player's game wager plus any bust wager is collected 24 and play by the player is terminated. Optionally, if a player has an automatic winning hand 22, and has been rewarded, the player may still be paid 35 on any bust wager, as described below.

Otherwise, a final player hand is formed 28 by inputting the player's selection to hit or stand through the input device 46. Additionally, in an optional embodiment, the player may additionally have the option to split or double down by placing at the wager receiver 48 a wager equal, or less than or equal, respectively, to the game wager. In an optional embodiment based on Blackjack, play by a player is terminated and the player loses his game wager if the player busts. Optionally, if a player busts, the player may still be paid 35 on any bust wager, as described below.

The final dealer hand is formed 30 by the data processor 40 according to the stored house rules. The final dealer hand and final player hand are compared 32 to the predetermined target value, 21 in the case of Blackjack, and the player is rewarded 34 on his game wager if the player's hand sum is closer to the target than the dealer's hand sum is, or if the dealer busts. Conversely, if the dealer's hand sum is closer to the target than the player's hand sum is, or, as discussed above, the player busts, the player loses 36 his game wager.

Each bust wager that has been placed 12 is resolved. In an optional embodiment, a player who placed 12 a bust wager is rewarded 35 on the bust wager if the dealer busts in exactly three cards. Conversely, the bust wager is collected by the house when the dealer does not bust or when the dealer busts in four or more cards. As above, while the pay out could be constant, it is also contemplated that the reward on the bust wager may vary with the value of the third playing card causing the dealer to bust. These pay outs could optionally vary according to Tables 1 and 2 given above. In the optional embodiment illustrated, the player could be paid 35 on the bust wager even in cases where the player is rewarded 26 for an automatic winning hand, or where the player has previously busted. In alternate optional embodiments, a player bust may result in losing the bust wager as well, and/or where a player has an automatic winning hand, the bust wager could be resolved immediately, optionally as a win, a loss, or a push.

While certain embodiments of the present invention have been shown and described it is to be understood that the present invention is subject to many modifications and changes without departing from the spirit and scope of the claims presented herein.

I claim:

1. A method of conducting a card game played between a dealer and a player using playing cards according to the conventional rules of Blackjack, the improvement comprising:

providing a physical deck of playing cards;

said player making a game wager;

said player opting to place a bust wager;

dealing two cards to form an initial dealer hand;

dealing two cards to form an initial player hand;

forming a final player hand by dealing at least one additional card to said initial player hand or standing on said initial player hand according to said conventional rules of Blackjack;

said dealer forming a final dealer hand by dealing at least one additional card to said initial dealer hand or standing on said initial dealer hand according to said conventional rules of Blackjack;

issuing a reward to said player on the player's game wager if the final player hand outranks the final dealer hand according to said conventional rules of Blackjack and collecting the player's game wager if the final dealer hand outranks the final player hand according to said conventional rules of Blackjack;

if said dealer busts according to said conventional rules of Blackjack, and said final dealer hand includes three playing cards, issuing a reward to said player based on said bust wager; and if said dealer does not bust according to said conventional rules of Blackjack, or said dealer busts according to said conventional rules of Blackjack with a final dealer hand including four or more playing cards, collecting said bust wager, wherein said reward based on said bust wager varies according to the value of the third playing card causing the dealer to bust.

2. The method of claim 1 wherein a modified deck of forty-eight playing cards is used, said modified deck consisting essentially of four cards each of Ace, deuce, thee, four, five, six, seven, eight, nine, Jack, Queen, and King.

3. The method of claim 2 wherein said reward based on the third playing card is:

Third Card Drawn Payout
Face Card 3 to 1
Nine 6 to 1
Eight 8 to 1
Seven 10 to 1
Six 15 to 1
Bonus for 8 8 8 of Same Color 50 to 1
Bonus for 8 8 8 Suited 200 to 1.

4. The method of claim 1 further comprising:

said player opting to place a split wager equal to the game wager and split said initial player hand according to said conventional rules of Blackjack if said initial player hand forms a pair; and said player opting to place a double down wager less than or equal to the game wager after said initial player hand is dealt according to said conventional rules of Blackjack.

5. The method of claim 1 wherein said reward based on the third playing card is:

Third Card Drawn Payout
King, Queen, Jack, or Ten 3 to 1
Nine 5 to 1
Eight 7 to 1
Seven 9 to 1
Six 15 to 1
Bonus for 8 8 8 of Same Color 50 to 1
Bonus for 8 8 8 Suited 200 to 1.

6. A method of conducting a game using playing cards played between a dealer, playing according to predetermined house rules, and a player, comprising:

providing a physical deck of playing cards;

said player making a game wager;

said player placing a bust wager;

dealing two cards to said dealer to form an initial dealer hand;

dealing two cards to said player to form an initial player hand;

if said initial player hand forms an automatic winning outcome, rewarding said player and terminating play by said player, otherwise said player forming a final player hand by opting to receive additional cards or stand on the initial player hand; revealing said initial dealer hand;

forming a final dealer hand according to said house rules;

resolving said game wagers by issuing a reward to said player on the player's game wager if the final player hand is closer to a predetermined target value than the final dealer hand is and collecting the player's game wager if the final dealer hand is closer to a predetermined target value than the final player hand is;

if said final dealer hand exceeds said predetermined target value, and said final dealer hand includes three playing cards, issuing a reward to said player based on said bust wager; and if said dealer does not exceed said predetermined target value, or said final dealer exceeds said predetermined target value with a final dealer hand including four or more playing cards, collecting said bust wager, wherein said reward based on said bust wager varies according to the value of the playing card causing the dealer to bust.

7. The method of claim 6 wherein a modified deck of forty-eight playing cards is used, said modified deck consisting essentially of four cards each of Ace, deuce, three, four, five, six, seven, eight, nine, Jack, Queen, and King.

8. The method of claim 6 further comprising:

said player opting to place a split wager equal to the game wager and split said initial player hand into separate player hands if said initial player hand forms a pair; and said player opting to place a double down wager less than or equal to the game wager after said initial player hand is dealt and receive only one additional playing card.

9. A device for conducting a game for a player, comprising:

a data processor;

a display communicating with said data processor;

a wager receiver communicating with said data processor;

an input device communicating with said data processor;

a data structure communicating with said data processor storing data representing playing cards, a set of house rules, and instructions executable by said data processor for conducting a method, the instructions comprising:

receiving a signal from said wager receiver in response to receipt of a game wager from said player;

receiving a signal from said wager device indicating receipt of a bust wager or receiving a signal from said wager device indicating said player declining said bust wager;

dealing two cards to said player to form an initial player hand;

if said initial player hand forms an automatic winning outcome, issuing a reward to said player and terminating play by said player, otherwise said player forming a final player hand by opting through said input device to receive additional cards or stand on the initial player hand;

dealing two cards to said dealer to form an initial dealer hand, at least one card not being exposed;

revealing said initial dealer hand at said display;

forming a final dealer hand according to said house rules;

resolving said wagers by issuing a reward to said player on the player's game wager if the final player hand is closer to a predetermined target value than the final dealer hand is and collecting the player's game wager if the final dealer hand is closer to a predetermined target value than the final player hand is;

if said dealer exceeds said predetermined target value, and said final dealer hand includes three playing cards, issuing a reward to said player based on said bust wager; and if said dealer does not exceed said predetermined target value, or said dealer exceeds said predetermined target value with a final dealer hand including four or more playing cards, collecting said bust wager, wherein said step of issuing a reward based on said bust wager further includes varying the size of said reward according to the value of the third playing card causing the dealer to bust.

10. The device of claim 9 wherein said data structure stores data representing a modified deck of forty-eight playing cards consisting essentially of four cards each of Ace, deuce, three, four, five, six, seven, eight, nine, Jack, Queen, and King.

11. The device of claim 10 wherein said reward based on the third playing card is:

Third Card Drawn Payout
Face Card 3 to 1
Nine 6 to 1
Eight 8 to 1
Seven 10 to 1
Six 15 to 1
Bonus for 8 8 8 of Same Color 50 to 1
Bonus for 8 8 8 Suited 200 to 1.

12. The device of claim 9 wherein said instructions further comprise:

if said initial player hand forms a pair, in response to receiving a split wager equal to the game wager at said wager receiver, splitting said initial player hand into separate player hands; and in response to receiving a double down wager less than or equal to the game wager at said wager receiver after said initial player hand is dealt, dealing only one additional playing card to said player hand.

13. The device of claim 9 wherein said reward based on the third playing card is:

Third Card Drawn Payout
King, Queen, Jack, or Ten 3 to 1
Nine 5 to 1
Eight 7 to 1
Seven 9 to 1
Six 15 to 1
Bonus for 8 8 8 of Same Color 50 to 1
Bonus for 8 8 8 Suited 200 to 1.

* * * * *